US006286350B1

(12) United States Patent
Schönenberger et al.

(10) Patent No.: US 6,286,350 B1
(45) Date of Patent: Sep. 11, 2001

(54) METHOD FOR HOT PRESSING OF WORKPIECES

(75) Inventors: Raymond Schönenberger, Rosenau (FR); Andreas Matt, Murg (DE); Michael Suter, Allschwil (CH)

(73) Assignee: Hatebur Umformmaschinen AG, Reinach (CH)

( * ) Notice: Subject to any disclaimer, the term of this patent is extended or adjusted under 35 U.S.C. 154(b) by 0 days.

(21) Appl. No.: 09/673,685

(22) PCT Filed: Apr. 19, 1999

(86) PCT No.: PCT/CH99/00155

§ 371 Date: Oct. 19, 2000

§ 102(e) Date: Oct. 19, 2000

(87) PCT Pub. No.: WO99/55475

PCT Pub. Date: Nov. 4, 1999

(30) Foreign Application Priority Data

Apr. 24, 1998 (CH) ..... 934/98

(51) Int. Cl.[7] ..... B21J 5/06

(52) U.S. Cl. ..... 72/39; 72/361

(58) Field of Search ..... 72/39, 40, 453.14, 72/453.01, 453.04, 453.05, 453.13, 344, 345, 361

(56) References Cited

U.S. PATENT DOCUMENTS

| | | | | |
|---|---|---|---|---|
| 3,120,769 | | 2/1964 | Habetur . | |
| 3,584,498 | * | 6/1971 | Beche | 72/453.04 |
| 3,748,887 | | 7/1973 | Widera . | |

FOREIGN PATENT DOCUMENTS

| | | |
|---|---|---|
| 594454 | 1/1978 | (CH) . |
| 1120848 | 12/1961 | (DE) . |
| 57177845 | 11/1982 | (JP) . |
| 60030545 | 2/1985 | (JP) . |
| 2521909 | 1/1997 | (JP) . |

* cited by examiner

*Primary Examiner*—Lowell A. Larson
(74) *Attorney, Agent, or Firm*—Selitto, Behr & Kim

(57) ABSTRACT

A hot-forming machine for the hot-pressing of workpieces comprises a die (5), an associated extendable and retractable ejector (7) and a forwardly and backwardly movable press ram (1). The ejector (7) is connected to a control piston (8) arranged displaceably in a pressure chamber (28). Liquid can flow out of the pressure chamber (28) via a liquid outlet bore (24) and a liquid discharge line (23). By means of a throttle (25) arranged in the liquid discharge line (23) the outflow of liquid and therefore the repulsion of the extended ejector (7) by the forwardly moving press ram (1) are delayed in such a way that a workpiece (4) arranged between ejector (7) and press ram (1) is pre-upset and descaled outside the die (5).

15 Claims, 4 Drawing Sheets

METHOD FOR HOT PRESSING OF WORKPIECES

FIELD OF THE INVENTION

The present invention relates to a method for the hot-pressing of workpieces and to a hot-forming machine for carrying out this method.

DESCRIPTION OF THE PRIOR ART

During hot-pressing, first a cylindrical workpiece is usually sheared off from a metal bar heated to forging temperature. As a result of the heating, the workpiece is surrounded by a scale casing, that is to say an oxide layer, which flakes off during the forming of the workpiece. There are basically two possibilities for descaling:

a) The workpiece with scale is introduced into the first or single die of a hot-forming machine, and the scale is broken off from the workpiece there during compression moulding with the aid of a press ram.

b) The workpiece with scale is pre-upset and descaled in a first forming station outside a die and is introduced, in a second forming station, into the first or single die of the hot-forming machine and compression-moulded there.

A multi-stage hot-forming machine, in which the scale is broken off from the workpiece in the die of the first forming station, is described in Japanese utility model No. 2521909. The disadvantage of flaking of the scale within the die is that the scale is for the most part pressed into the workpiece again. This results in a poorer surface quality, thus necessitating more comprehensive cutting finish-machining and more machining outlay, with the result that the amount of material required, and therefore the costs per workpiece, are increased.

The disadvantages are avoided by hot-forming machines in which descaling takes place in a separate first forming action. CH 594 454 describes such a hot-forging press, in which the workpieces are pre-upset outside a die by a press ram, this also being called free upsetting, the scale breaking off from the workpieces and falling down. The descaled and pre-upset workpiece is then transported, by means of a transport gripper, into the second forming station and introduced into the die thereof, in which die the workpiece is compression-moulded.

Although this ensures that the flaked-off scale is not pressed into the workpiece again, an additional forming stage is necessary for this purpose. Moreover, the outside diameter of the pre-upset workpiece varies, since the upsetting force in the case of an empty adjacent forming station, which may occur during normal operation, for example after a conventional dropping of the ends of the metal bar, is greater than when the adjacent forming stations are full. A self-centring transport gripper is therefore virtually indispensable for transporting the workpiece.

A vertical forming machine for forming a workpiece in a closed die is known from JP-A-60030545. A descending slide presses at first an upper outer ram in a die against the workpiece which has been introduced before. Afterwards, an upper inner ram and a lower inner ram are pressed from above and below in the workpiece under pressure control. The ejection of the formed workpiece is finally carried out by means of a lower outer ram. A pre-upsetting of the workpiece outside the die is not provided for.

In view of the disadvantages of the above-described descaling methods known hitherto, the present invention is based on the following object. A method for the hot-pressing of workpieces that have been heated to forging temperature is to be provided, in which descaling of the workpieces takes place outside a die, without an additional forming station being required for this purpose.

SUMMARY OF THE INVENTION

The essence of the invention is that, in a method for the hot-pressing of workpieces, in which a workpiece heated to forging temperature is descaled outside a die by pre-upsetting by means of a press ram and is thereafter pressed to the desired shape in one or more dies, the pre-upsetting and the compression moulding take place in the first or single die by the same press ram in the same cycle of movement of the latter.

By virtue of the invention, a workpiece to be pressed can in a single forming station by a single press ram in one cycle of movement first be pre-upset and descaled outside a die and thereafter be compression-moulded in a die. Since descaling takes place outside a die, that is to say in a freestanding manner, the flaked-off scale is not pressed into the workpiece again, so that the surface quality of the latter is not impaired. Moreover, as compared with the hot-forming machine described in CH 594 454, a forming station can be saved, nor is a self-centering transport gripper necessary, since transport to the next forming station takes place only after compression moulding in the die, after which the workpieces have a well defined outer contour. The hot-pressing method according to the invention thus combines the advantages of both of the known descaling methods described above, without exhibiting their disadvantages.

A preferred exemplary embodiment of a hot-forming machine for carrying out the method according to the invention comprises at least one die, an associated extendable and retractable ejector and a forwardly and backwardly movable press ram. According to the invention, there are means by which the repulsion of the extended ejector by the forwardly moving press ram via a workpiece arranged between ejector and press ram can be delayed in such a way that the workpiece can thereby be pre-upset outside the die.

When a hot-forming machine of this type is in operation, the workpiece is pre-upset outside the die, pushed into the die and compression-moulded there by the forwardly moving press ram in the same cycle of movement, and is finally pushed out of the die again by the ejector. In a multi-stage hot-forming machine, the workpiece is then transferred to the next forming station in a known way.

The means for delaying the repulsion of the ejector and the introduction of the workpiece into the die may be, for example, hydraulic, pneumatic, mechanical or electromechanical means.

Hydraulic or pneumatic delay means comprise, in a preferred exemplary embodiment, a control piston, arranged in a pressure chamber and connected directly or indirectly to the ejector, and means for the supply and discharge of liquid or gas into and out of the pressure chamber. The liquid or gas discharge means are designed in such a way that the liquid or gas discharge from the pressure chamber takes place partially with a delay and delays the repulsion of the control piston and the ejector. They advantageously comprise a liquid or gas discharge line, in which is arranged a throttle or a pressure relief valve, opening only at a particular liquid or gas pressure, or which is opened and closed by means of a control pin.

An advantageous hot-forming machine according to the invention with mechanical delay means comprises a rotatable cam for controlling the extension and retraction of the ejector, the said cam being so shaped and its rotation so coordinated with the forward and backward movement of the press ram that the repulsion of the extended ejector takes place with a delay.

BRIEF DESCRIPTION OF THE INVENTION

Exemplary embodiments of the method according to the present invention, for the hot-pressing of workpieces, and the hot-forming machine according to the present invention, for carrying out the method, are described in more detail below with reference to the accompanying drawings, in which.

DETAILED DESCRIPTION OF THE INVENTION

FIG. 1

Figure 1:
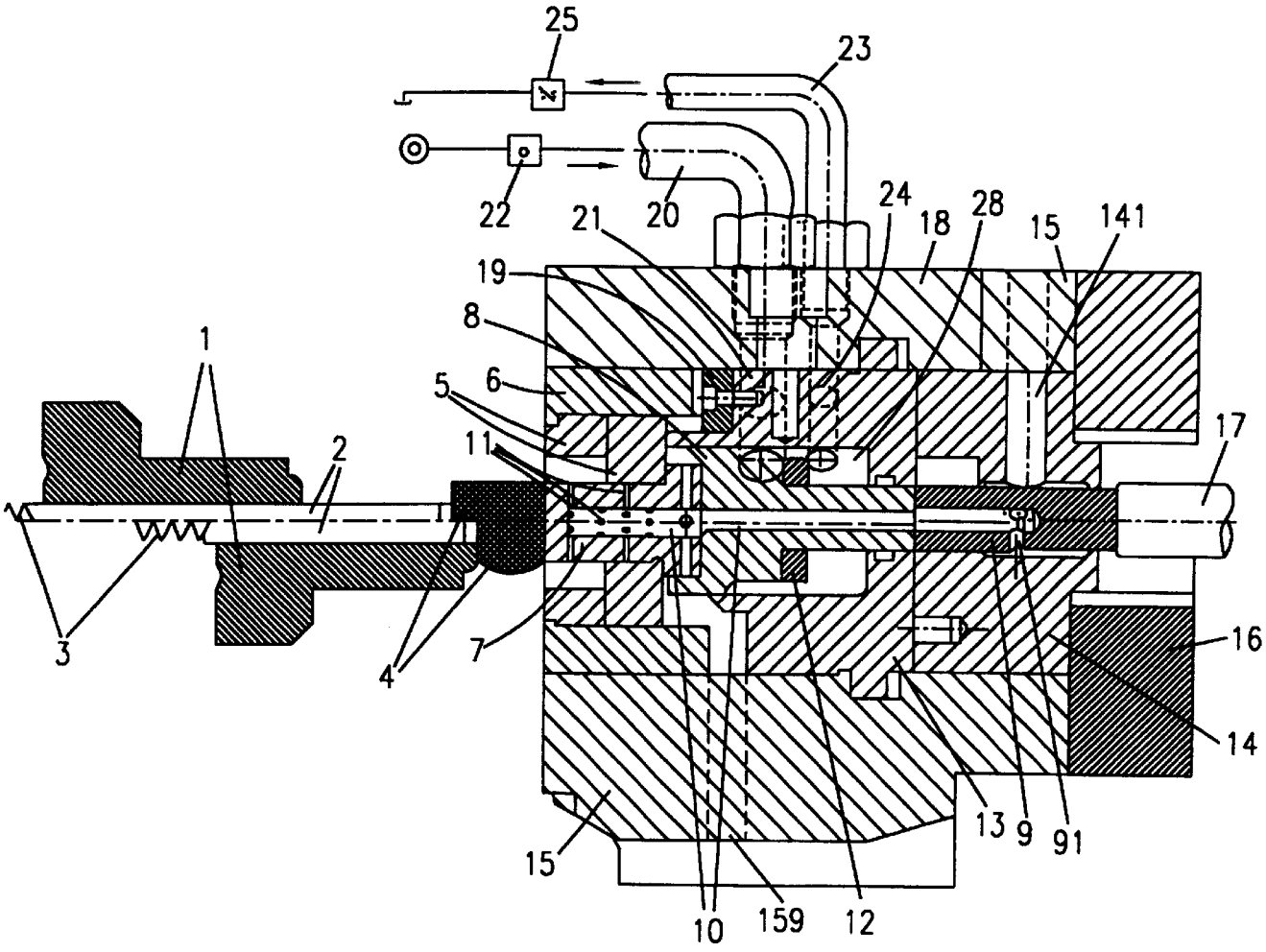
FIG. 1 shows a sectional view of a part of a first exemplary embodiment of a hot-forming machine according to the invention with hydraulic delay means having a throttle during pre-upsetting.

The illustrated first exemplary embodiment of a hot-forming machine according to the invention comprises a die 5 which is arranged by means of a die holder 6 between an anvil 15 and an anvil cover 18 and which serves for the reception and compression moulding of a workpiece 4. The bottom of the die 5 has a bore for an extendable and retractable ejector 7 which serves during pre-upsetting as press resistance for the workpiece 4 bearing on it, during compression moulding as a shaping part for the workpiece 4 and, after compression moulding, for pushing the formed workpiece out of the die 5. The ejector 7 is connected to a control piston 8 which is arranged displaceably in a pressure chamber 28 and which is provided with a thrust ring 12 for setting the ejector position. The pressure chamber 28 is formed in a clamping ring 13, to which the die holder 6 is screwed via a position key 19.

At the end located opposite the ejector 7, the control piston 8 is connected to an ejector bolt 9, the latter being connected to an ejector rod 17 which is indirectly displaceable, by means of a cam not shown, in the direction of the die 5 in a known way. The ejector bolt 9 is guided in a back stay 14 which also serves for absorbing compressing forces and which bears on a thrust plate 16. A cooling duct 141 is arranged in the back stay 14 and a cooling duct 91 is arranged in the ejector bolt 9, coolant being capable of being supplied via the said cooling ducts to a die bore 10 extending axially in the control piston 8 and ejector 7. Outlet orifices 11 are provided in the ejector 7 for the cooling and flush-cleaning of the die 5. In order to prevent a pumping action of the control piston 8 on the same side as the ejector 7 while the formed workpiece 4 is being pushed out of the die 5, the clamping ring 13 is provided with a coolant relief orifice 159 which leads through the anvil 15.

The clamping ring 13 and the anvil cover 18 are provided with a liquid inlet bore 21, illustrated by broken lines, and with a liquid outlet bore 24, likewise illustrated by broken lines. A liquid supply line 20, in which a non-return valve 22 is arranged, is connected to the liquid inlet bore 21. Connected to the liquid outlet bore 24 is a liquid discharge line 23, in which a throttle 25, capable of being used up to a pressure of 350 bar, is arranged for the purpose of delaying the outflow of liquid from the pressure chamber 28.

The pressing of the workpiece 4 takes place by means of a press ram 1 which is illustrated, here, with each half in two different positions. In the upper position, the still unformed workpiece 4 is held between a holding pin 2, prestressed towards the die 5 by means of a tension spring 3, and the ejector 7. The holding pin 2 may alternatively also be prestressed by means of air pressure. In the lower position, the press ram 1 has already pre-upset and descaled the workpiece 4 and is now beginning to push the latter into the die 5.

The workpiece 4 is pre-upset by the forwardly moving press ram 1, in that the ejector 7 is held in its extended position by the control piston 8 on account of the resistance of the throttle 25 against an outflow of liquid from the pressure chamber 28. A slight yielding, that is to say retraction, of the ejector 7 during pre-upsetting has no adverse influence on descaling and the removal of the scale outside the die 5. After pre-upsetting, the workpiece 4 is pushed into the die 5 by the press ram 1 which moves further forwards, the resistance of the throttle 25 against an outflow of liquid being overcome by the rising pressure, and is compression-moulded there. After compression moulding, the ejector 7, driven by the abovementioned cam, not illustrated, via the ejector rod 17, the ejector bolt 9 and the control piston 8, pushes the workpiece 4 out of the die 5 again, so that, for example, the said workpiece can be taken over by a transport gripper.

FIG. 2

The second exemplary embodiment illustrated differs from the first in that a pressure relief valve 26 with a control line 27 is arranged, instead of a throttle 25, in the liquid discharge line 23. For example, a pressure relief valve for up to about 350 bar from the company Bieri, Berne, may be used. At the end of pre-upsetting, due to the forwardly moving press ram 1, the pressure on the control piston 8 and therefore in the pressure chamber 28 and liquid discharge line 23 is increased so sharply that the previously closed pressure relief valve 26 is opened via the control line 27 and liquid can therefore flow out. As a result, the ejector 7 is retracted and the workpiece 4 is introduced into the die 5 and compression-moulded there. The workpiece 4 and the press ram 1 are shown here at the end of compression moulding.

Reference is hereafter made to the description of the first exemplary embodiment.

FIG. 3

In this third exemplary embodiment, in contrast to the first two, the liquid discharge line 29 is led through the clamping ring 13, the back stay 14 and the anvil 15. The front part of a control pin 30 firmly connected to the ejector rod 17 is capable of being moved forwards and backwards in a bore 31 in the back stay 14, the said control pin closing the liquid discharge line 29 or leaving it completely or partially open, depending on its position.

As in FIG. 1, the pressing of the workpiece 4 at two different times is illustrated here. In the upper half of the figure, the still unformed workpiece 4 is held between the prestressed holding pin 2 and the ejector 7. The rear part of the control pin 30 bears on the ejector bolt 9, and its front part closes the liquid discharge line 29, so that liquid cannot flow out of the pressure chamber 28. The ejector rod 17 and the control pin 30 then begin to move backwards and the workpiece 4 is subsequently pre-upset by the forwardly moving press ram 1, until the situation illustrated in the lower half of the figure is finally reached, that is to say the workpiece 4 is pre-upset and descaled and the control pin 30 is immediately prior to opening the liquid discharge line 29. The ejector rod 17 and the control pin 30 are subsequently moved even further backwards, so that liquid can flow out of the pressure chamber 28 via the liquid discharge line 29, with the result that the control piston 8 and the ejector 7 are pushed in the direction of the ejector rod 17 and the workpiece 4 is pushed into the die 5. The length of the control pin 30 may be selected according to the pre-upsetting travel desired in each case.

So that the ejector rod 17 and the control pin 30 connected to it can be moved backwards before the ejector bolt 9, the control piston 8 and the ejector 7, on the one hand the cam indirectly controlling the ejector rod 17 must be designed in such a way that it allows a backward movement of this kind, and, on the other hand, means must be provided which ensure this backward movement. In the exemplary embodiment illustrated, the backward movement is generated by a spring 32. It may, however, also be envisaged, for example, to couple the ejector rod 17 in an articulated manner to an ejector lever controlled via the cam, so that the said ejector rod is not only pushed forwards, but also pulled backwards, by the said ejector lever.

Reference is hereafter made to the description of the first exemplary embodiment.

FIG. 4

The illustrated fourth exemplary embodiment of a hot-forming machine according to the invention comprises a machine body 130 and a tool block 100, in which are arranged a die 105 and an associated extendable and retractable ejector 107 which corresponds essentially to the ejector 7 of the first exemplary embodiment. The ejector 107 is connected via an ejector bolt 109 to an axially displaceable ejector rod 117. An ejector lever 150 rotatable about a shaft 152 has a thrust bolt 151 for the ejector rod 117 and a freely rotatable roller 153 which bears on a cam 160. The ejector lever 150 is prestressed by means of a tension spring 170, in such a way that the roller 153 bears constantly on the cam 160.

When the cam 160 is rotated by means of a shaft 161 rotating in the direction of the arrow during operation, the ejector lever 150 is pivoted outwards and inwards, during the outward movement, to which the lever position shown is prior, the thrust bolt 151 pushing the ejector rod 117 in the direction of the die 105, so that the ejector 107 is extended. The cam 160 is so shaped and its rotation so coordinated with the forward and backward movement of the press ram, not shown here, that the repulsion of the extended ejector 107 takes place with a delay. When the roller 153 bears on the cam 160 in the region A, the ejector 107 is on stand-by in the extended position. The press ram moves forwards towards the die 105, but does not yet press against a workpiece arranged between ejector 107 and press ram. While the roller 153 rolls in the region B on the cam 160 as a result of the further rotation of the latter, the press ram moves further forwards and pre-upsets the workpiece, the scale on the latter flaking off. After leaving the region B, the ejector lever 150 is pivoted back again, and the press ram pushes the ejector 107 and the pre-upset workpiece into the die 105 where the latter is compression-moulded. The workpiece is thereafter pushed out of the die 105 again and transferred, for example by means of a transport gripper, into a further forming station. The entire operation then recommences from the front with a next workpiece. For workpieces of different height, the cam 160 can be rotated relative to the shaft 161 on the latter, so that a shift in the pre-upsetting time can be achieved.

Figure 2:
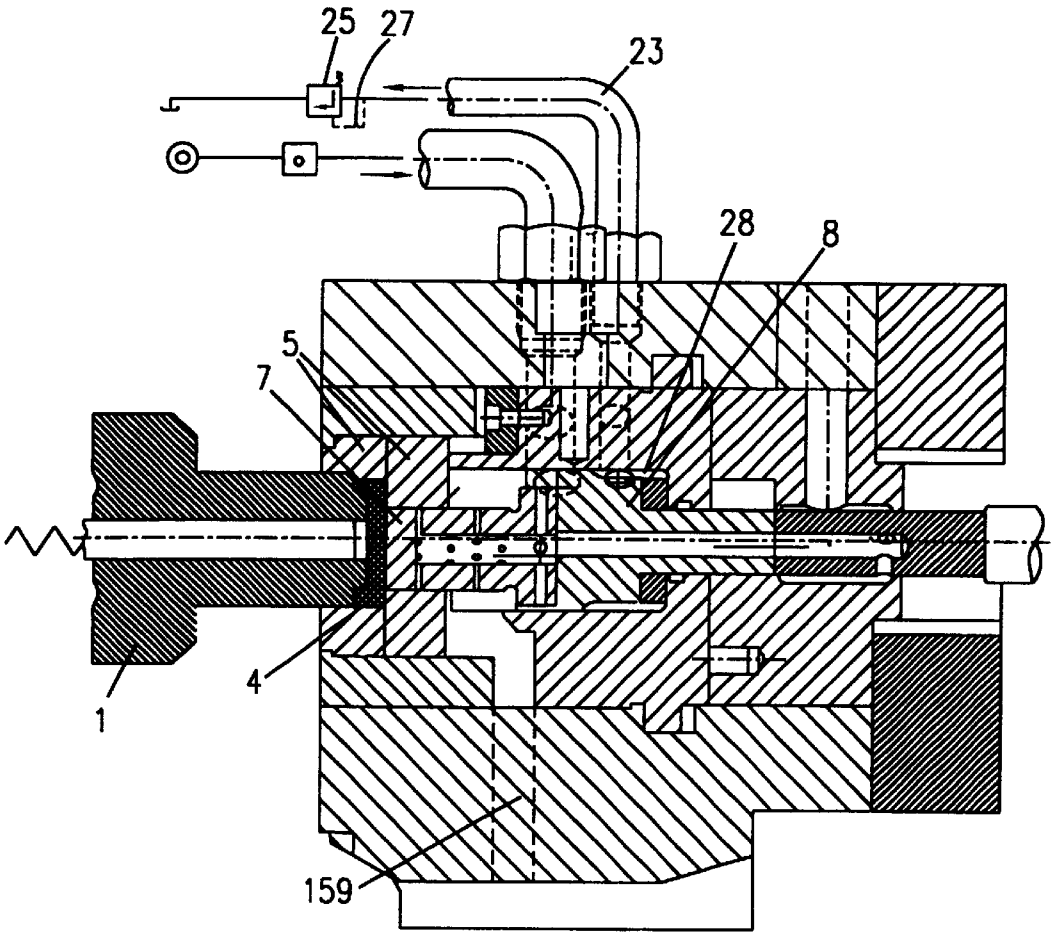
FIG. 2 shows a sectional view of a part of a second exemplary embodiment of a hot-forming machine according to the invention with hydraulic delay means having a pressure relief valve, instead of the throttle, at the end of compression moulding.
Figure 3:
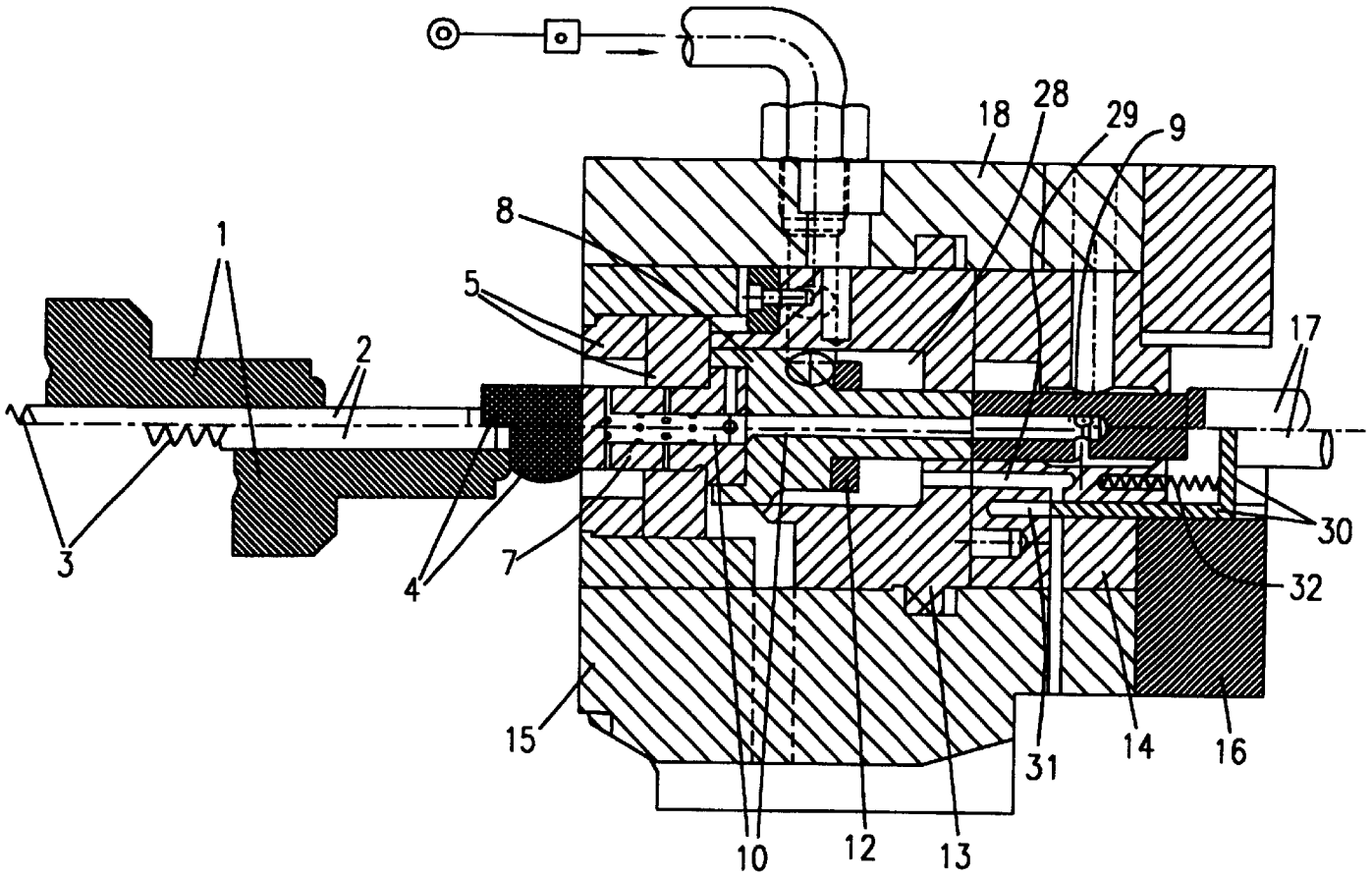
FIG. 3 shows a sectional view of a part of a third exemplary embodiment of a hot-forming machine according to the invention with hydraulic delay means having a control pin during pre-upsetting.
Figure 4:
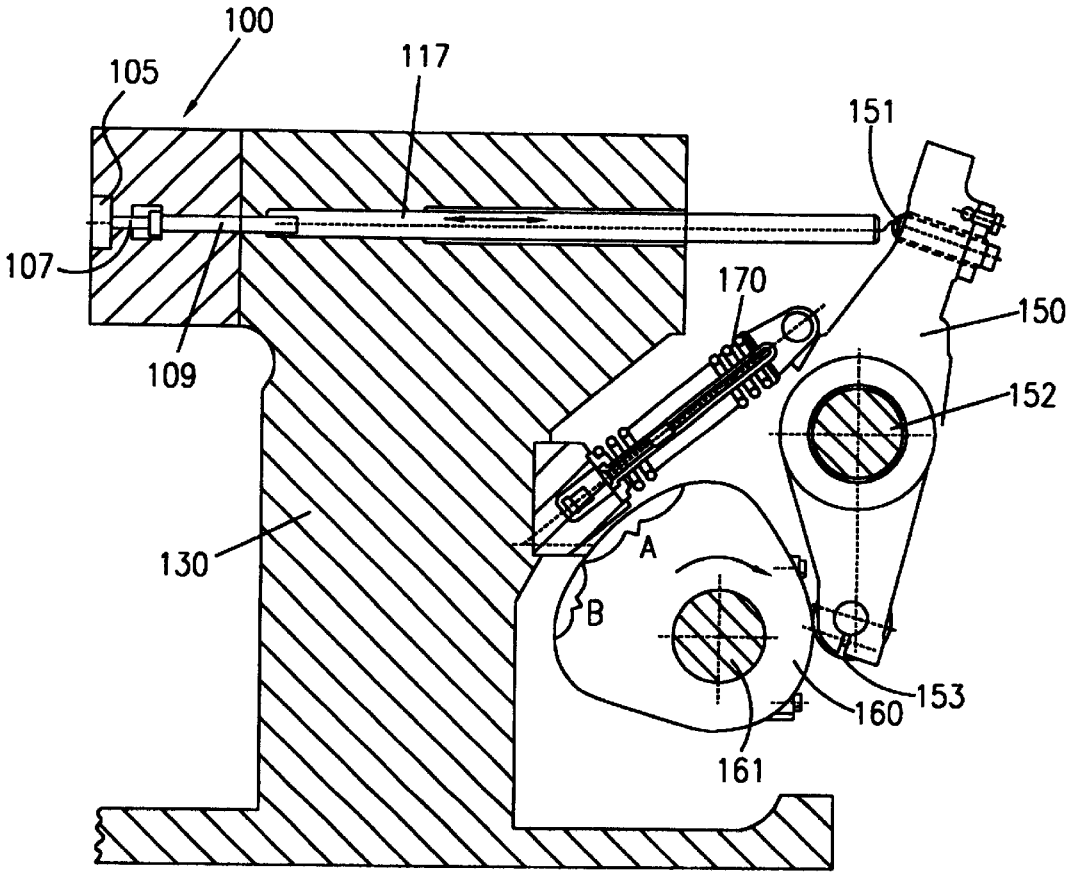
FIG. 4 shows a sectional view of a part of a fourth exemplary embodiment of a hot-forming machine according to the invention with mechanical delay means.

Other variations of the above-described methods and hot-forming machines for the hot-pressing of workpieces can be implemented. It may also be mentioned expressly, here, that, instead of the hydraulic devices illustrated in FIGS. 1 to 3, similarly designed pneumatic devices provided with the necessary seals may also be envisaged.

We claim:

1. In a method for the hot-pressing of workpieces, in which a workpiece heated to forging temperature is descaled outside a die by pre-upsetting with a press ram and is thereafter compression moulded to the desired shape within said die, the improvement wherein the pre-upsetting and the compression moulding are both accomplished by the same press ram during a single cycle of movement of said press ram.

2. The method according to claim 1, wherein said die is the first of a plurality of dies.

3. The method according to claim 1 or 2, wherein, during pre-upsetting, the workpiece is held outside said die by an extended ejector of said die and, after pre-upsetting, is conveyed by pressure generated in response to the forward movement of said press ram into said die, where it is compression-moulded as a result of the further forward movement of said press ram.

4. The method according to claim 3, wherein the workpiece is already being moved towards said die during pre-upsetting, but the speed of movement of said workpiece during pre-upsetting is less than the speed of movement of said workpiece after pre-upsetting.

5. In a hot-forming machine for hot-pressing workpieces, which machine includes a die, an ejector that is moveable between an extended position and a retracted position, and a forwardly and backwardly movable press ram, the improvement comprising delay means by which the movement of said ejector from its said extended position to its said retracted position in response to the forward movement of said press ram, via a workpiece arranged between said ejector and said press ram, is delayed such that the workpiece is pre-upset outside said die and is then compression moulded within said die using the same said press ram during a single cycle of movement of said press ram.

6. The hot-forming machine according to claim 5, wherein said delay means includes a control piston positioned in a pressure chamber and connected directly to said ejector, fluid supply means for supplying fluid to said pressure chamber, and fluid discharge means for discharging fluid from said pressure chamber, said fluid discharge means being adapted such that the discharge of fluid from said pressure chamber occurs partially with a delay, thereby delaying the retraction of said control piston and said ejector.

7. The hot-forming machine according to claim 6, wherein said fluid discharge means includes a fluid discharge line and a throttle positioned within said fluid discharge line.

8. The hot-forming machine according to claim 6, wherein said fluid discharge means includes a fluid discharge line and a pressure relief valve that opens only at a predetermined fluid pressure and which is positioned within said fluid discharge line.

9. The hot-forming machine according to claim 6, wherein said fluid discharge means includes a fluid discharge line which is opened and closed by means of a control pin.

10. The hot-forming machine according to claim 9, wherein said control pin is connected to a forwardly and backwardly movable ejector rod for moving said ejector into its said extended position, and further including means for moving said ejector rod backwards prior to the movement of said ejector to its said retracted position.

11. The hot-forming machine according to claim 5, further comprising a rotatable cam for controlling the movement of said ejector between its said extended position and its said retracted positions, said cam being shaped and its rotation coordinated with the forward and backward movement of said press ram such that the movement of said ejector from its said extended position to its said retracted position occurs with a delay.

12. The hot-forming machine according to claim 11, wherein the position of said rotatable cam relative to the position of said press ram is adjustable.

13. The hot-forming machine according to claim 11 or 12, further comprising an ejector lever that is moveable outwards and inwards by means of said rotatable cam and which moves said ejector between its said extended position and its said retracted position via an ejector rod.

14. The hot-forming machine according to claim 11 or 12, further comprising an ejector lever that is moveable outwards and inwards by means of said rotatable cam and which moves said ejector between its said extended position and its said retracted position via an ejector rod and an ejector bolt.

15. The hot-forming machine according to claim 5, wherein said delay means includes a control piston positioned in a pressure chamber and connected indirectly to said ejector, fluid supply means for supplying fluid to said pressure chamber, and fluid discharge means for discharging fluid from said pressure chamber, said fluid discharge means being adapted such that the discharge of fluid from said pressure chamber occurs partially with a delay, thereby delaying the retraction of said control piston and said ejector.

* * * * *